US006845714B1

(12) United States Patent
Smith et al.

(10) Patent No.: US 6,845,714 B1
(45) Date of Patent: Jan. 25, 2005

(54) ON-BOARD POWER GENERATION SYSTEM FOR A GUIDED PROJECTILE

(75) Inventors: Brian J. Smith, Huntsville, AL (US); Kevin D. Kennedy, Huntsville, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/751,494

(22) Filed: Jan. 9, 2004

Related U.S. Application Data

(62) Division of application No. 10/463,934, filed on Jun. 16, 2003, now abandoned.

(51) Int. Cl.[7] ..... F42C 11/00
(52) U.S. Cl. ..... 102/208; 102/225
(58) Field of Search ..... 102/208, 225

(56) References Cited

U.S. PATENT DOCUMENTS 2,468,120 A * 4/1949 Senn ..... 102/208
2,766,964 A * 10/1956 Almquist et al. ..... 102/208
2,990,776 A * 7/1961 Clarke ..... 102/208
3,170,403 A * 2/1965 Heilprin ..... 102/208
3,401,635 A * 9/1968 Rabinow ..... 102/208
3,611,943 A * 10/1971 Popper ..... 102/208
3,772,992 A * 11/1973 Moore et al. ..... 102/208
3,826,193 A * 7/1974 Rognmo et al. ..... 102/208
4,201,136 A * 5/1980 Morris ..... 102/208
4,586,436 A * 5/1986 Denney et al. ..... 102/208
4,665,332 A * 5/1987 Meir ..... 102/208
4,858,530 A * 8/1989 Edminister et al. ..... 102/208
4,898,342 A * 2/1990 Kranz et al. ..... 102/208

OTHER PUBLICATIONS

National Defense, vol. LIX, No. 326, pp 146–148, Barron, (1974).*

* cited by examiner

*Primary Examiner*—Harvey E. Behrend
(74) *Attorney, Agent, or Firm*—Hay Kyung Chang

(57) ABSTRACT

On-Board Power Generation System for a Guided Projectile eliminates the need for batteries as a power source to power the guiding mechanism residing inside the projectile. Instead, an electrical generator and a wind-driven turbine to drive the generator are utilized to produce power. In this way, a small portion of the projectile's kinetic energy is converted into electrical energy. The power thusly produced is, then, coupled to the guiding means. The projectile is appropriately configured to accommodate therein the power generaion system and air inlets and exhaust ports that are necessary to enable the system to operate.

3 Claims, 5 Drawing Sheets

ON-BOARD POWER GENERATION SYSTEM FOR A GUIDED PROJECTILE

DIVISIONAL APPLICATION

This application for patent is a divisional application of prior nonprovisional application, Ser. No. 10/463,934, filed on Jun. 16, 2003 now abandoned. The said prior application is hereby incorporated herein by reference.

DEDICATORY CLAUSE

The invention described herein may be manufactured, used and licensed by or for the Government for governmental purposes without the payment to us of any royalties thereon.

BACKGROUND OF THE INVENTION

The U.S. military forces currently are facing a variety of low-cost air-borne threats that include unguided rockets, mortars, unmanned aerial vehicles and cruise missiles. The traditional response to these threats has been to engage them with sophisticated guided missiles. Such guided missile engagements are technically viable but very expensive. A more cost-effective means of countering the low-cost threats would be to use guided medium caliber (20 mm–40 mm) projectiles.

Such projectiles can be launched out of guns that are positioned on combat vehicles. Guns possess significant operational advantages over other weapon systems in local air defense and other close engagements, the primary advantage being a significant increase in the number of stowed kills. Hundreds of medium caliber gun rounds can be stored in the same space as ten missiles. Additionally, bullets carry a substantial cost savings over missile systems, thereby allowing a more liberal use-during the battle.

However, to be effective, guns must have some capabilities that are not normally required by an artillery system: specifically, a very short targeting time, capability against highly agile targets and enhanced precision. Guided smart munitions would provide such capabilities. Further, they would alleviate any targeting errors that may result from launch biases and improve lethality by allowing enhanced aimpoint selection.

A critical aspect in the development of guided projectiles is the power generation to provide power to the guiding means that will reside inside the projectiles. The power generating means must be lightweight and suitable for incorporation into an environment that has limited space and is subject to significant spin rates and high shock loading.

SUMMARY OF THE INVENTION

Traditional and thermal batteries are not suitable for use as power sources for guided projectiles due to their size and relatively short shelf life. On-Board Power Generation System for a Guided Projectile does away with the need for the battery by utilizing, instead, an electrical generator to produce power and a wind-driven turbine to drive the generator. In this way, a small portion of the projectile's kinetic energy is converted into electrical energy. The power output of the generator is, then, coupled to the guiding means. The projectile is appropriately configured to accommodate therein the power generation system and the air inlets and exhaust ports necessary to enable the system to function.

DESCRIPTION OF THE PREFERRED EMBODIMENT

Figure 1:
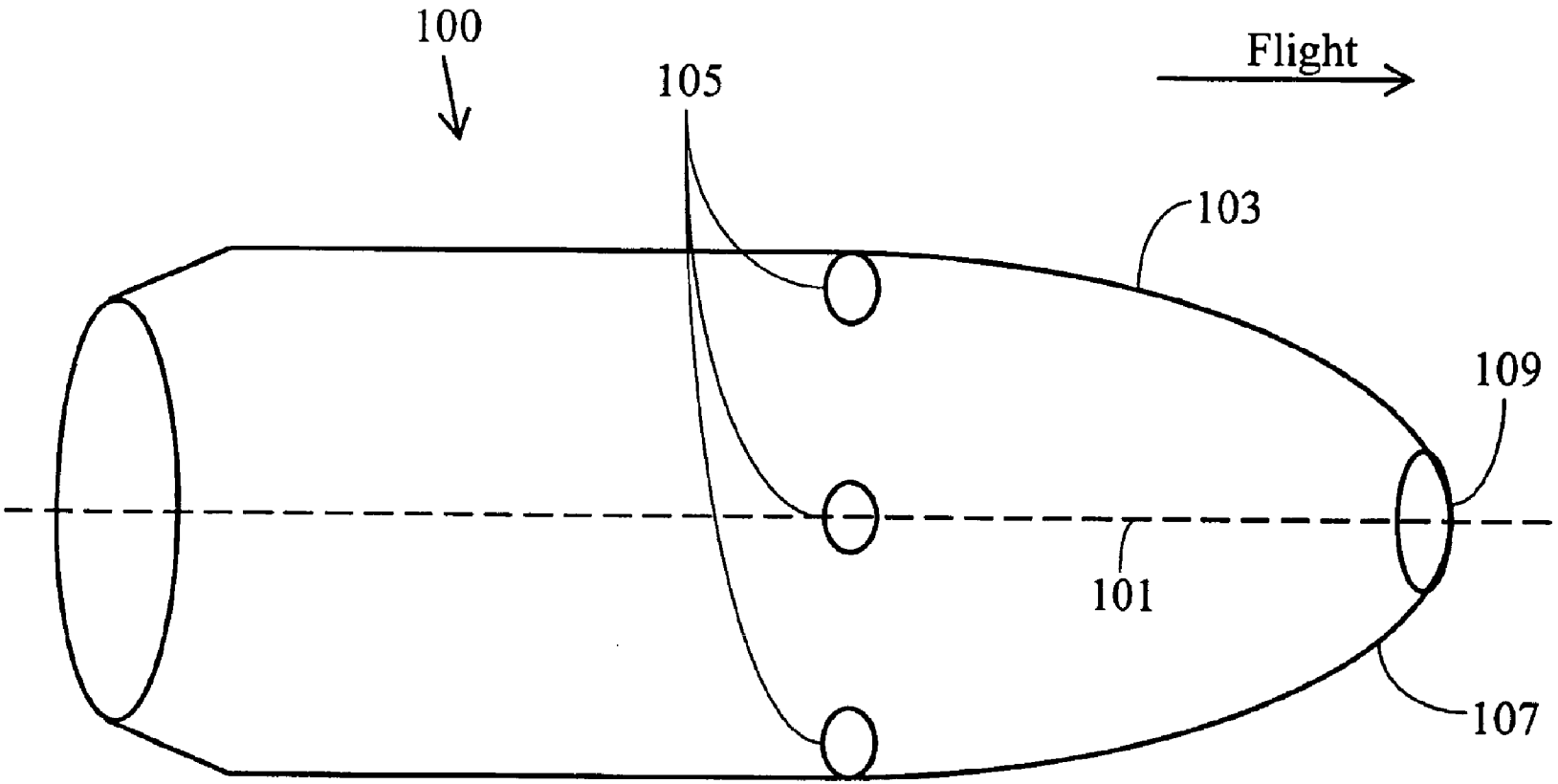
FIG. 1 shows an exterior view of a typical guided projectile utilizing the On-Board Power Generation System for a Guided Projectile.
Figure 2:
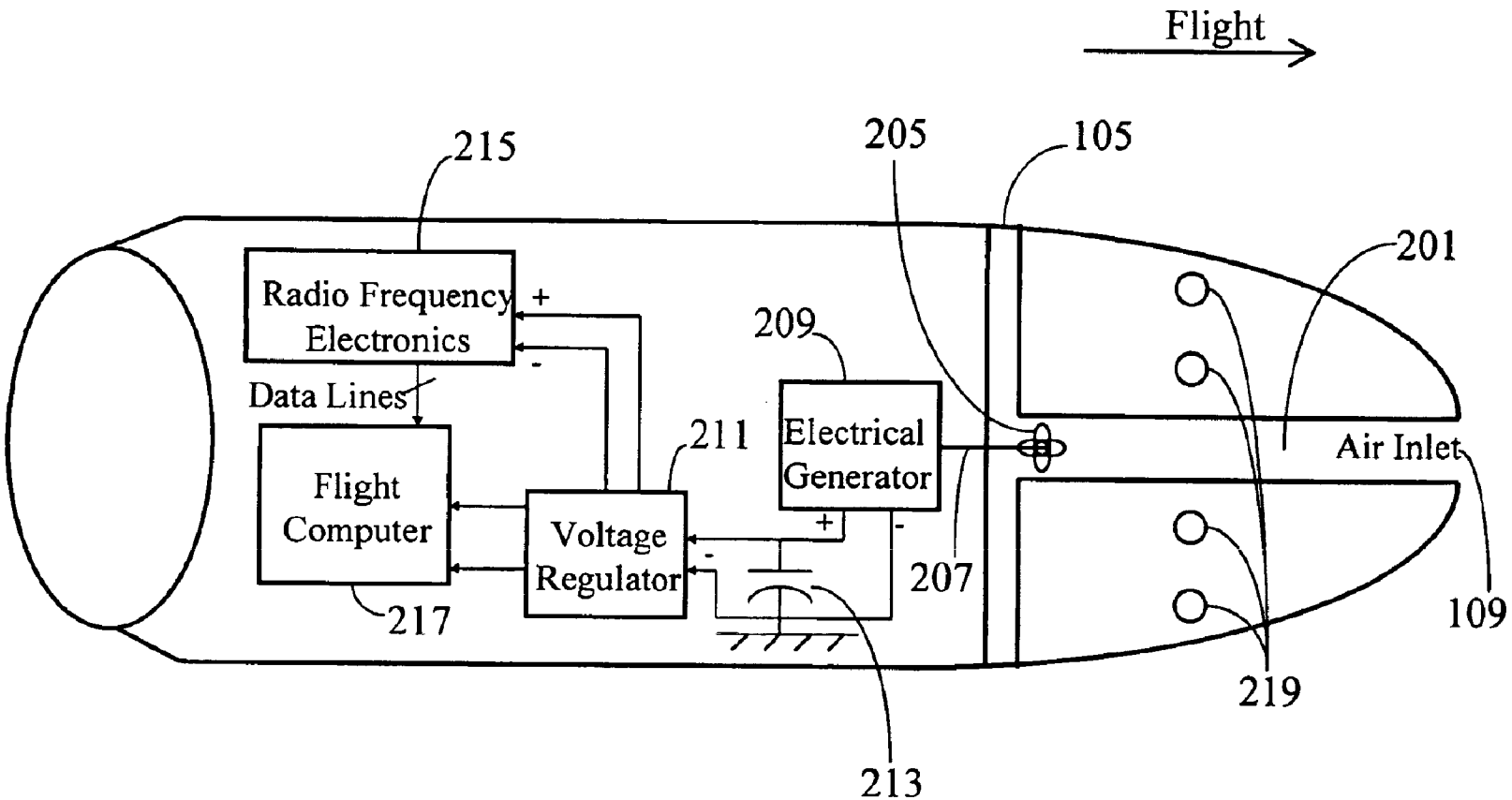
FIG. 2 is a diagram of the preferred embodiment of the On-Board Power Generation System for a Guided Projectile.

Referring now to the drawing wherein like numbers represent like parts in each of the several figures, arrowheads indicate signal travel and the direction of the flight of guided projectile 100 is to the right, the configuration and operation of the On-Board Power Generation System for a Guided Projectile is explained in detail.

As shown in FIG. 1, the preferred embodiment has an air inlet 109 at forward end 107 and a plurality of exhaust ports 105 on housing 103. The projectile further has longitudinal axis 101 about which it rotates in a given direction during its flight toward a selected target. In addition, the projectile contains a guiding means such as radio frequency electronics 215 and flight computer 217 to guide it for a greater accuracy in impacting the target.

Figure 3:
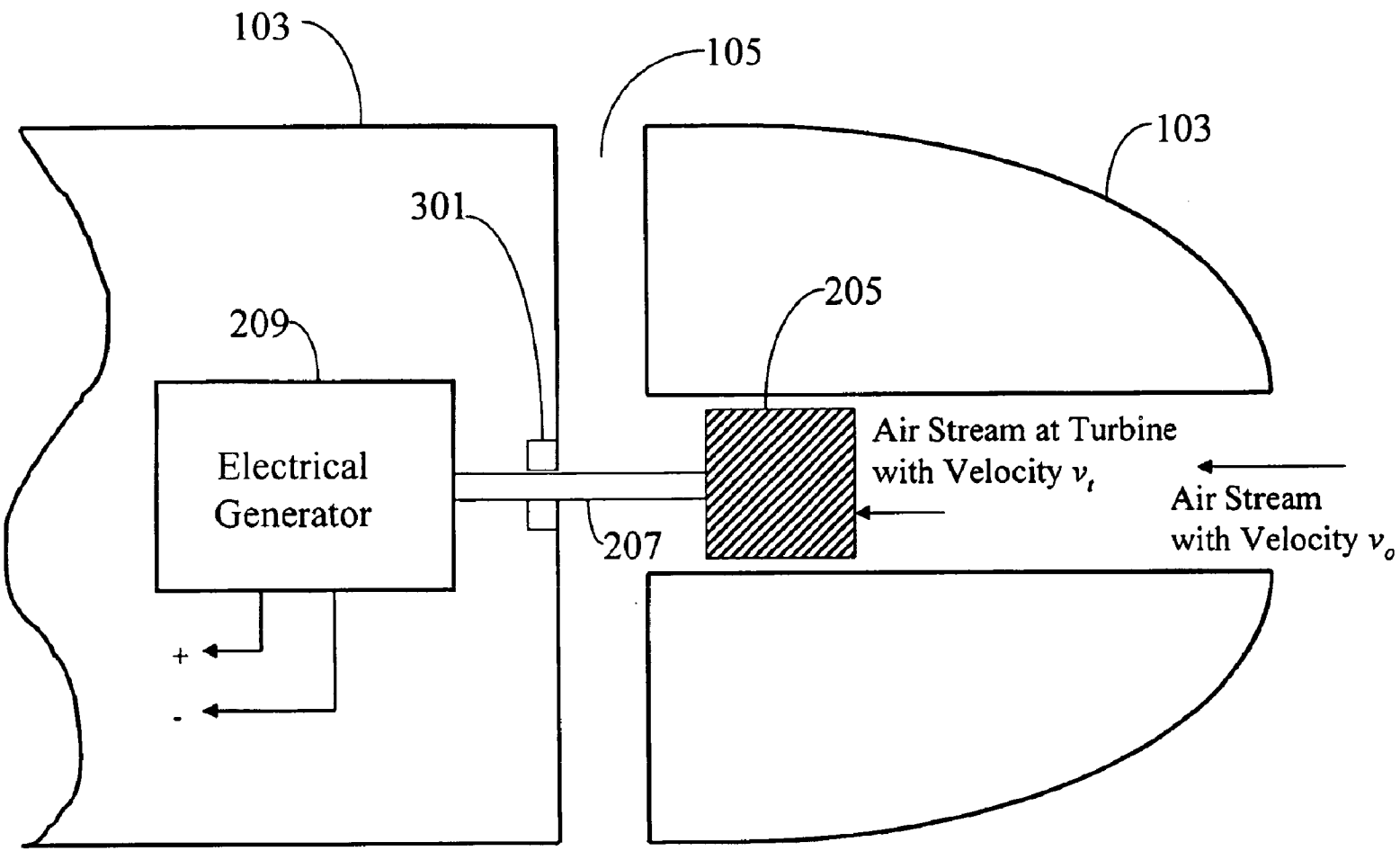
FIG. 3 shows details of the turbine section of the system.
Figure 5:
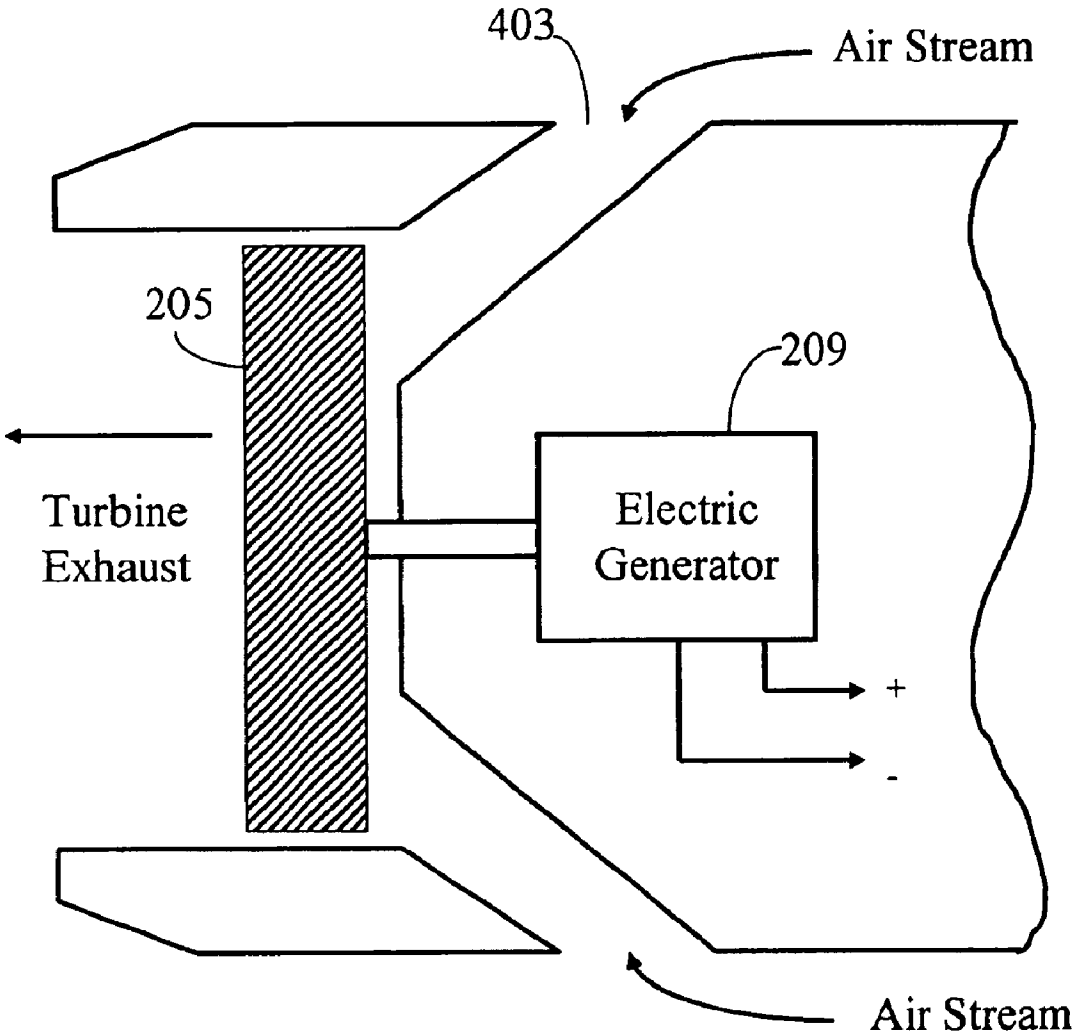
FIG. 5 details the turbine section of the alternate embodiment.

The On-Board Power Generation System to provide the necessary power to the guiding means comprises cylindrical hole 201 drilled from air inlet 109 through the middle of the projectile to exhaust ports 105, turbine 205 mounted at the end of the cylindrical hole near the exhaust ports and electrical generator 209 coupled to the turbine. As the air stream passes over the turbine, the vanes of the turbine turn in a direction that is opposite of the rotation direction of the projectile. The relative positions of the vanes to each other at any given point in time during their rotation is indicated by the slanted lines, as shown in FIGS. 3 and 5. The turbine whose vanes rotate thusly drives the electrical generator which, in response, produces voltage output. The output of the generator is input to capacitor 213 that performs low-pass filtering to smooth the output and stores the output for use in short-term, high-energy demand situations such as firing thrusters 219 or operating other control surfaces (not shown). Additionally, voltage regulator 211 is placed between the capacitor and the guiding means to stabilize the voltage further.

Electrical generator 209 is coupled to turbine 205 by shaft 207. As illustrated in FIG. 3, the turbine converts the energy of the fluid stream into kinetic energy by use of the channeled air stream against the turbine vanes. The air stream enters through inlet 109, passes through the turbine and exits radially from the projectile through exhaust ports 105. The rotating motion of the turbine vanes drives the shaft, thus driving the generator. The spacing between the vanes of the turbine is determined by the power generation requirement, which, in turn, is determined by the speed of the projectile.

Figure 4:
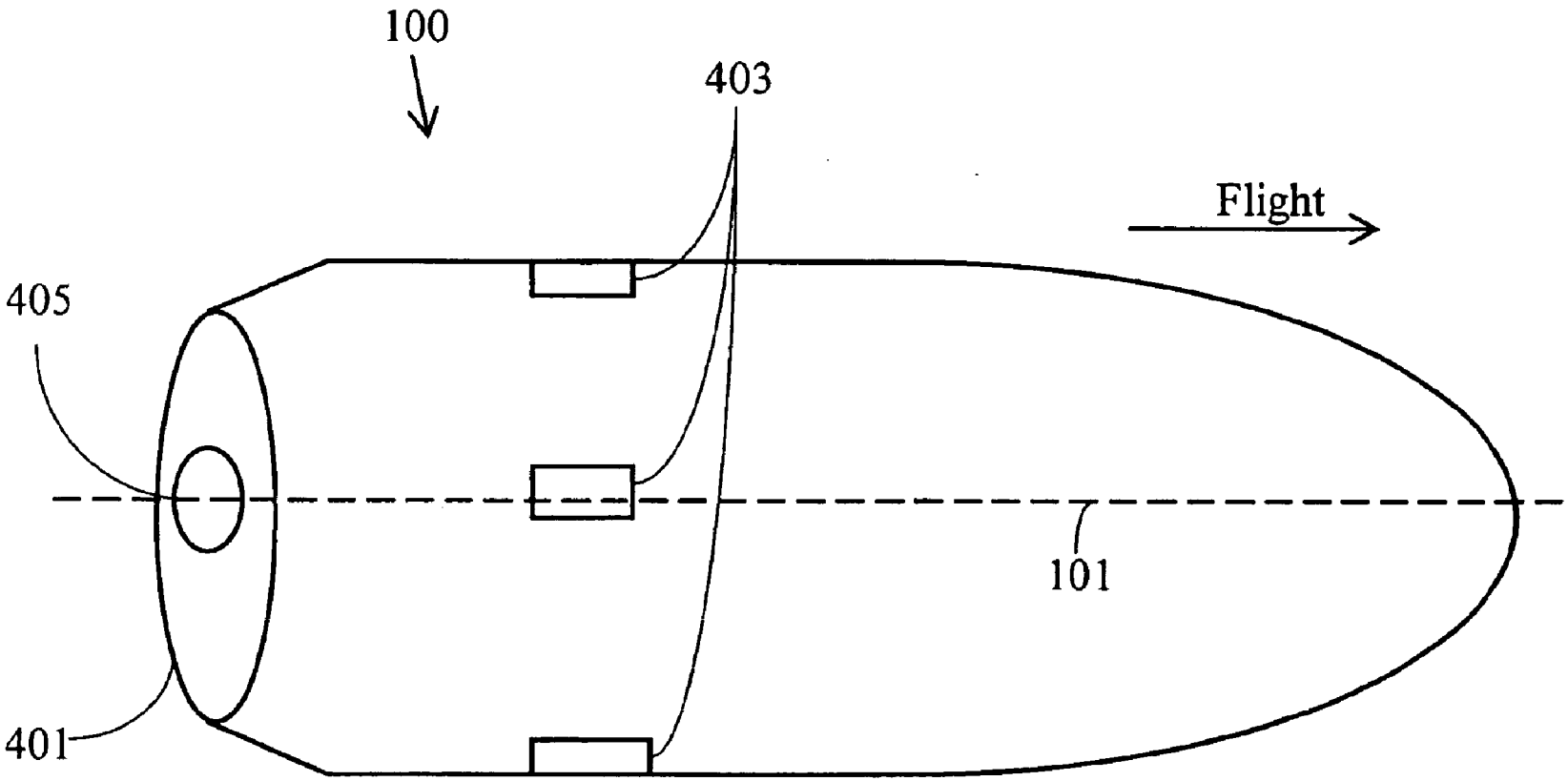
FIG. 4 is an exterior view of a guided projectile with an alternate embodiment of the On-Board Power Generation System for a Guided Projectile.

An alternate embodiment, illustrated in FIGS. 4 and 5, places an exhaust port 405 at aft end 401 and multiple air inlets 403 on the housing. Turbine 205 is placed toward the rear of the projectile and the air inlets are positioned between the turbine and electrical generator 209 as shown in FIG. 5. This embodiment reduces the projectile drag, because the incoming air stream passes through the turbine further down the body of the projectile, but is less energetic than the preferred embodiment and, consequently may require a higher air stream velocity or a larger turbine.

Although particular embodiments and forms of this invention have been illustrated, it is apparent that various modifications and other embodiments of the invention may be made by those skilled in the art without departing from the scope and spirit of the foregoing disclosure. One modification is to add high-speed bearings 301 adjacent to shaft 207 as shown in FIG. 3 to render stability to the shaft. Accordingly, the scope of the invention should be limited only by the claims appended hereto.

We claim:

1. In a projectile having a means therein for guiding said projectile during its flight toward a selected target, said projectile further having a housing, an aft end and a longitudinal axis and rotating during flight in a first direction about said axis, a system for generating voltage output to power said guiding means, said generating system residing in said projectile and comprising: a turbine positioned within said housing, said turbine having a plurality of vanes; an electrical generator coupled to said turbine; an exhaust port located at said aft end to allow any exhaust gases to escape; a plurality of inlet holes, said inlet holes being located on said housing and being positioned so as to allow air to enter therethrough and impinge on said vanes and cause said vanes to rotate in a second direction; said exhaust port being in fluid communication with said plurality of inlet holes by means of said turbine; and a means for coupling said generator to said turbine so as to enable said turbine to drive said generator and cause said generator to produce voltage output, said voltage output being input to said guiding means to power said guiding means.

2. A system for generating power for a guided projectile as set forth in claim 1, wherein said system further comprises: a capacitor coupled to said generator, said capacitor performing low-pass filtering to smooth said voltage output and to store said voltage output.

3. A system for generating power as set forth in claim 2, wherein said second rotating direction is opposite from said first rotating direction.

* * * * *